US012108837B1

(12) United States Patent
Corsi et al.

(10) Patent No.: US 12,108,837 B1
(45) Date of Patent: Oct. 8, 2024

(54) BOOT COVER

(71) Applicants: Mary L. Corsi, Brooklyn, NY (US); Seh Norris, Brooklyn, NY (US)

(72) Inventors: Mary L. Corsi, Brooklyn, NY (US); Seh Norris, Brooklyn, NY (US)

(73) Assignee: LaFoo Hard Goods, LLC, Brooklyn, NY (US)

( * ) Notice: Subject to any disclaimer, the term of this patent is extended or adjusted under 35 U.S.C. 154(b) by 0 days.

(21) Appl. No.: 17/659,553

(22) Filed: Apr. 18, 2022

(51) Int. Cl.
*A43B 5/04* (2006.01)
*A43B 5/18* (2006.01)

(52) U.S. Cl.
CPC ..... *A43B 5/0415* (2013.01); *A43B 5/18* (2013.01)

(58) Field of Classification Search
CPC ..... A43B 5/0415; A43B 3/16; A43B 3/18
See application file for complete search history.

(56) References Cited

U.S. PATENT DOCUMENTS 4,069,599 A * 1/1978 Alegria ..... A43B 3/20 36/106
5,694,703 A * 12/1997 Diaz ..... A43B 3/163 36/7.7
7,475,501 B1 * 1/2009 DeToro ..... A43C 11/1493 36/110
D597,734 S 8/2009 Beckett
10,561,195 B2 * 2/2020 Jurgeto ..... A43B 3/20

OTHER PUBLICATIONS

Webpage printout from: www.rei.com/product/891156/dryguy-boots-gloves, showing "DryGuy Boot Gloves", copyright 2022 Recreational Equipment, Inc.

* cited by examiner

*Primary Examiner* — Khoa D Huynh
*Assistant Examiner* — Erick I Lopez
(74) *Attorney, Agent, or Firm* — Tuggle Duggins P.A.; Blake P. Hurt; Reinier R. Smit

(57) ABSTRACT

A shell with a flap for covering first and second portions of a ski boot is disclosed herein. Two sets of mating fasteners are attached to the flap and shell, respectively. The first mating pair prevents the flap from displacing from the second portion of the ski boot when fastened, causing the flap to fully cover the second portion. The second mating pair causes the flap to partially cover the second portion of the ski boot, leaving a section exposed for access by a user. The shell also includes two straps and a hoop. The first strap embraces a bottom portion of the ski boot while the second strap is inserted through the hoop and embraces a heel portion of the ski boot.

20 Claims, 11 Drawing Sheets

PRIOR ART

BOOT COVER

FIELD OF THE INVENTION

The invention herein pertains to accessories for boots, and particularly pertains to a cover for ski boots that insulates the ski boot from the cold, preventing heat loss from the foot of a user, and reducing moisture from entering the ski boot in an aesthetically pleasing way.

DESCRIPTION OF THE PRIOR ART AND OBJECTIVES OF THE INVENTION

Outdoor activities such as skiing, specifically alpine skiing, represent hobbies enjoyed by a significant portion of the globe. Alpine skiing involves skiing downhill on trails with varying inclines, widths, sharpness of turns, roughness of terrain, and levels of grooming. Between 2017 and 2018, it was estimated that nearly 9.2 million Americans were active skiers or snowboarders. However, to safely engage in skiing, the average skier must be outfitted in the necessary equipment. Modern ski equipment includes skis, ski boots, bindings, helmets, and other protective gear. Ski boots are an often-overlooked skiing accessory that derive its hidden value from the control they offer their wearer. Modern ski boots are typically composed of two parts, the inner boot, and the outer shell. The outer shell provides stability and structure which protects the skier's leg and ankles from injury. The inner boot is responsible for cushioning part of the ski boot and insulating the skier's foot from the frigid outside temperatures.

However, on particularly cold days or days where the skier is engaging in outdoor activity for an extended period of time, the inner boot may fail to prevent the internal temperature of the ski boot from falling below comfortable levels. Many products have been developed to prevent decline of the eternal temperature of the ski boot. For example, U.S. Pat. No. D597,734, claims a ski boot cover design which would likely serve a functional purpose of keeping the user's foot warm within a ski boot and appears to have a means of attaching to the ski boot at two attachment points. The DryGuy BootGlove sold at www.rei.com/product/891156/dryguy-boots-gloves (last visited Dec. 13, 2021) also similarly is designed to attach to a ski boot at two attachment points and insulate the skier's foot to prevent the internal temperature from falling below comfortable levels.

Regardless of these, and other, attempts to better insulate skiers' feet within the confines of a ski boot, the current solutions may be improved. Thus, in view of the problems and disadvantages associated with the prior art devices, the present disclosure was conceived and one of its objectives is to provide a boot cover with a flap that may be displaced to allow the skier to access the buckles of their ski boot without having to remove the entire boot cover.

It is another objective of the present disclosure to provide a boot cover that insulates the ski boot and prevents the internal temperature of the ski boot from dropping to uncomfortable levels.

It is another objective of the present disclosure to provide a boot cover that conforms to the geometry of a top portion of a ski boot.

It is still another objective of the present disclosure to provide a boot cover that is anchored to the ski boot with straps.

It is yet another objective of the present disclosure to provide a boot cover that is anchored to the ski boot with straps that wrap around a bottom portion of the ski boot and an ankle portion of the ski boot.

It is a further objective of the present disclosure to provide a boot cover that is anchored to the ski boot with an elastic strap that is in tension and exerts a force against the bottom portion of the ski boot.

It is still a further objective of the present disclosure to provide a boot cover that is anchored to the ski boot with a strap with two surfaces that are capable of mating with each other.

It is yet a further objective of the present disclosure to provide a boot cover that has a flap which is fastenable to a shell of the boot cover at multiple points.

It is another objective of the present disclosure to provide a boot cover that has a shell and a flap that cover a substantial portion of the top part of the ski boot.

Various other objectives and advantages of the present disclosure will become apparent to those skilled in the art as a more detailed description is set forth below.

SUMMARY OF THE INVENTION

The aforesaid and other objectives are realized by providing a boot cover formed from a shell and a flap. The shell covering a first portion of a ski boot, and the flap covering a second portion of the ski boot different from the first portion. The shell includes an outer shell surface and inner shell surface. The flap includes an outer flap surface and inner flap surface. The shell and flap each include a first fastener component and a second fastener component. The first shell fastener component and first flap fastener component prevent the flap from displacing from the second portion of the ski boot when fastened and cause the flap to fully cover the second portion. The second shell fastener component and second flap fastener component of the flap cause the flap to partially cover the second portion when fastened. The shell also includes two straps and a hoop. The first strap is connected at two positions in opposing relation with one and other on the shell. The first strap is configured to embrace a bottom portion of the ski boot. By embracing the bottom portion of the ski boot, the first strap prevents the shell and flap from displacing from the first portion and second portion of the ski boot, respectively. The second strap and hoop are each connected to the shell at a position in opposing relation with the other. The second strap defines a first and second gripping surface. The first and second gripping surfaces are each formed from hook-and-loop fasteners that facilitate a releasable attachment of the first gripping surface to the second gripping surface when mated with each other. When the second strap is inserted through the hoop and a portion of the first gripping surface nearest to an end of the second strap that is not attached to the shell is attached to a portion of the second gripping surface nearest to an end of the second strap that is attached to the shell, the shell and flap are prevented from displacing from the first portion and second portion of the ski boot respectively. Both the first strap and second strap are each configured to prevent the boot cover from displacing from the ski boot. The boot cover further comprises a shell fastener strip and a flap fastener strip. The shell fastener strip is positioned on an outer shell surface, and the flap fastener strip is positioned on the inner flap surface. The shell fastener strip and the flap fastener strip cooperate to releasably attach the flap to the shell. The cooperation of the shell fastener strip and the flap fastener strip causes the flap to fully cover the second portion of the ski boot.

DETAILED DESCRIPTION OF THE PREFERRED EMBODIMENT AND OPERATION OF THE INVENTION

Figure 1:
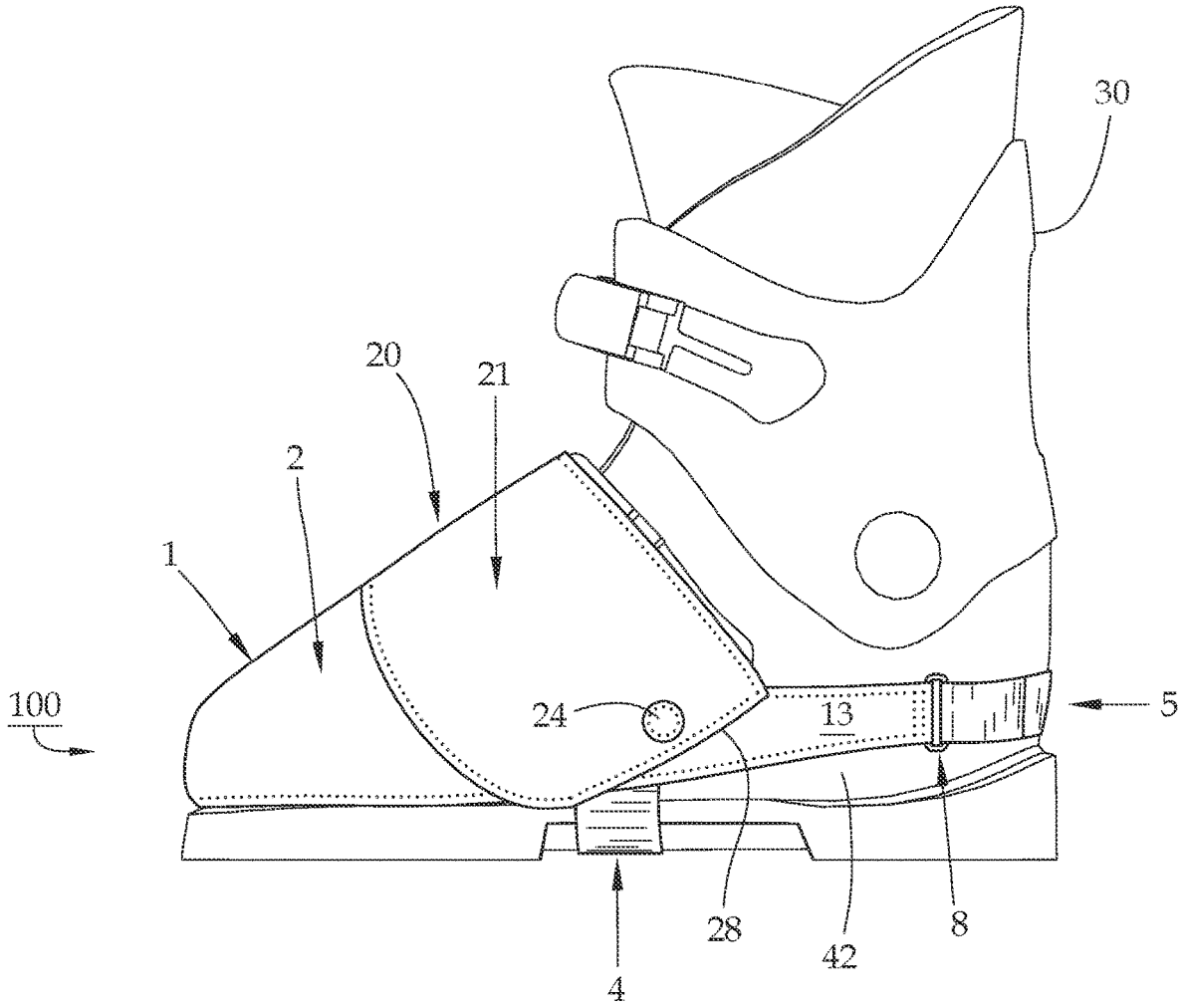
FIG. 1 shows an elevated side view of a preferred embodiment of a boot cover, with a flap fastened to a shell and a first and second portion of a ski boot covered by the shell and flap, respectively.
Figure 2:
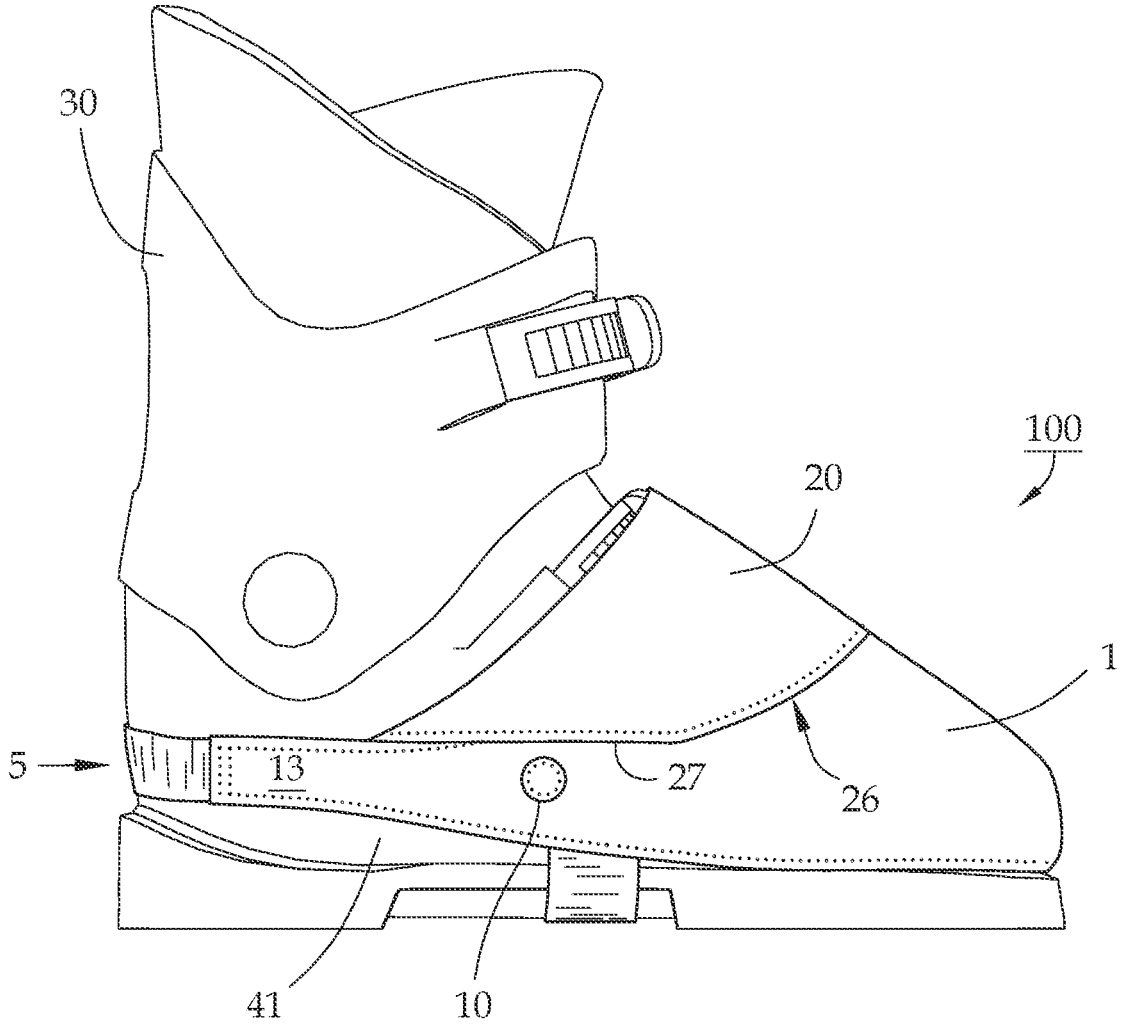
FIG. 2 pictures an elevated side view of the opposing side of the boot and cover shown in FIG. 1.

Various exemplary embodiments of the present disclosure are described below. Use of the term "exemplary" means illustrative or by way of example only, and any reference herein to "the disclosure" is not intended to restrict or limit the disclosure to exact features or step of any one or more of the exemplary embodiments disclosed in the present specification. References to "exemplary embodiment", "one embodiment", "an embodiment", "various embodiments", and the like may indicate that the embodiment(s) of the disclosure so described may include a particular feature, structure, or characteristic, but not every embodiment necessarily incudes the particular feature, structure, or characteristic. Further, repeated use of the phrase "in one embodiment", "in an exemplary embodiment", or "in an alternative embodiment" do not necessarily refer to the same embodiment, although they may.

It is also noted that terms like "preferably", "commonly", and "typically" are not utilized herein to limit the scope of the disclosure or to imply that certain features are critical, essential, or even important to the structure or function of the disclosure. Rather, these terms are merely intended to highlight alternative or additional features that may or may not be utilized in a particular embodiment of the present disclosure.

The present disclosure is described more fully hereinafter with reference to the accompanying figures, in which one or more exemplary embodiments of the disclosure are shown. Like numbers used herein refer to like elements throughout. The disclosure may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limited as to the scope of the disclosure, and any and all equivalents thereof. Moreover, many embodiments such as adaptations, variations, modifications, and equivalent arrangements will be implicitly disclosed by the embodiments described herein and fall within the scope of the instant disclosure.

Although specific terms are employed herein, they are used in a generic and descriptive sense only and not for the purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. Where only one item is intended, the terms "one and only one", "single", or similar language is used. When used herein to join a list of items, the term "or" denotes at least one of the items but does not exclude a plurality of items of the list.

For exemplary methods or processes of the disclosure, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present disclosure.

Additionally, any references to advantages, benefits, unexpected results, or operability of the present disclosure are not intended as an affirmation that the disclosure has previously been reduced to practice or that any testing has been performed. Likewise, unless stated otherwise, use of verbs in the past tense (present perfect or preterit) is not intended to indicate or imply that the disclosure has previously been reduced to practice or that any testing has been performed.

As used to herein, the term "boot cover" is used to refer to a device that is ideally suited for insulating footwear such as boots with respect to temperature and/or moisture, for example a conventional ski boot. In one or more embodiments, the boot cover is configured (i.e. sized, shaped, and generally intended) to be releasably attachable to a ski boot. The boot cover further insulates a foot within the ski boot, preventing the internal temperature of the ski boot from dropping below levels which are uncomfortable or dangerous for a skier.

Figure 8:
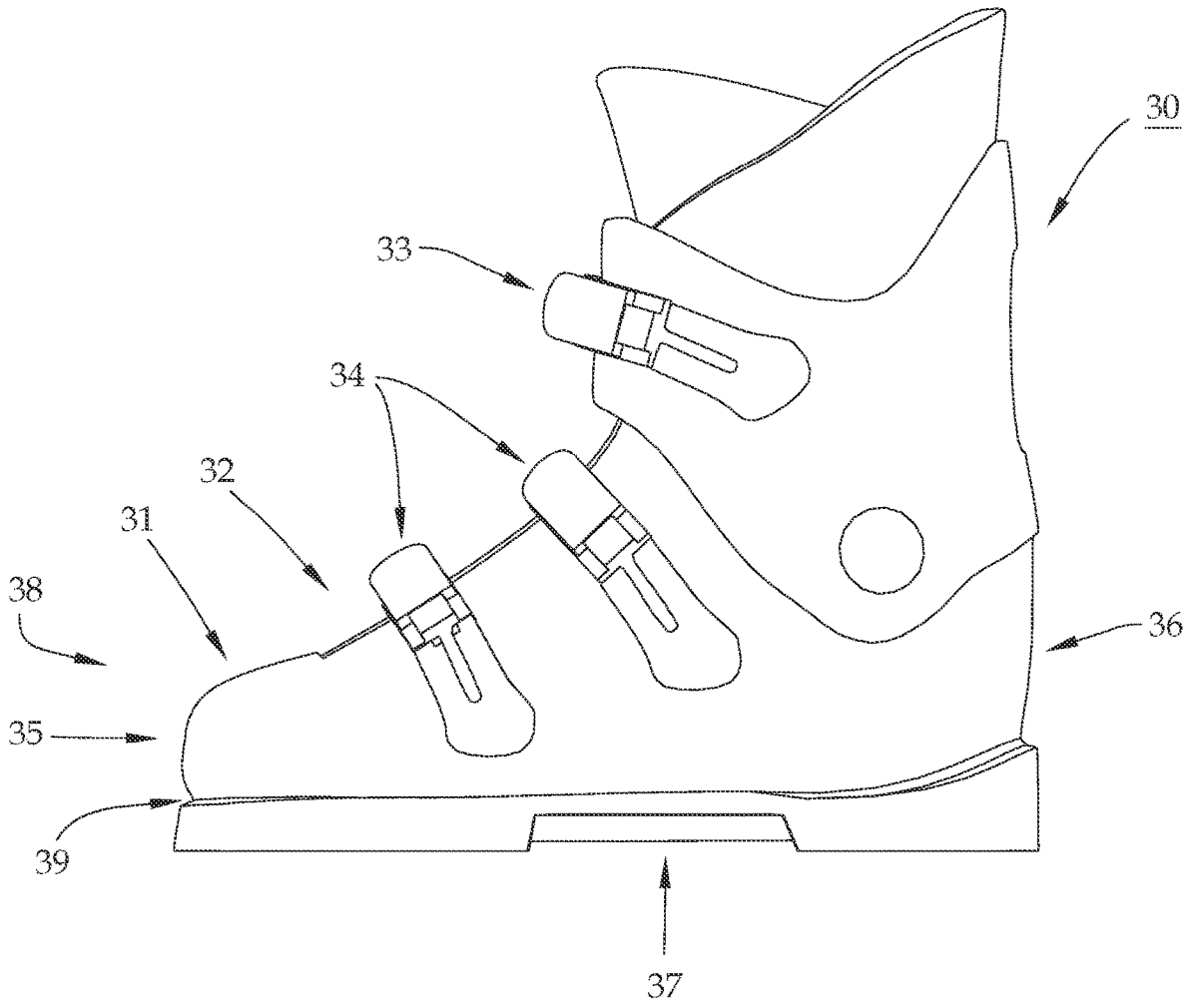
FIG. 8 illustrates an elevated side view of a conventional ski boot.
Figure 9:
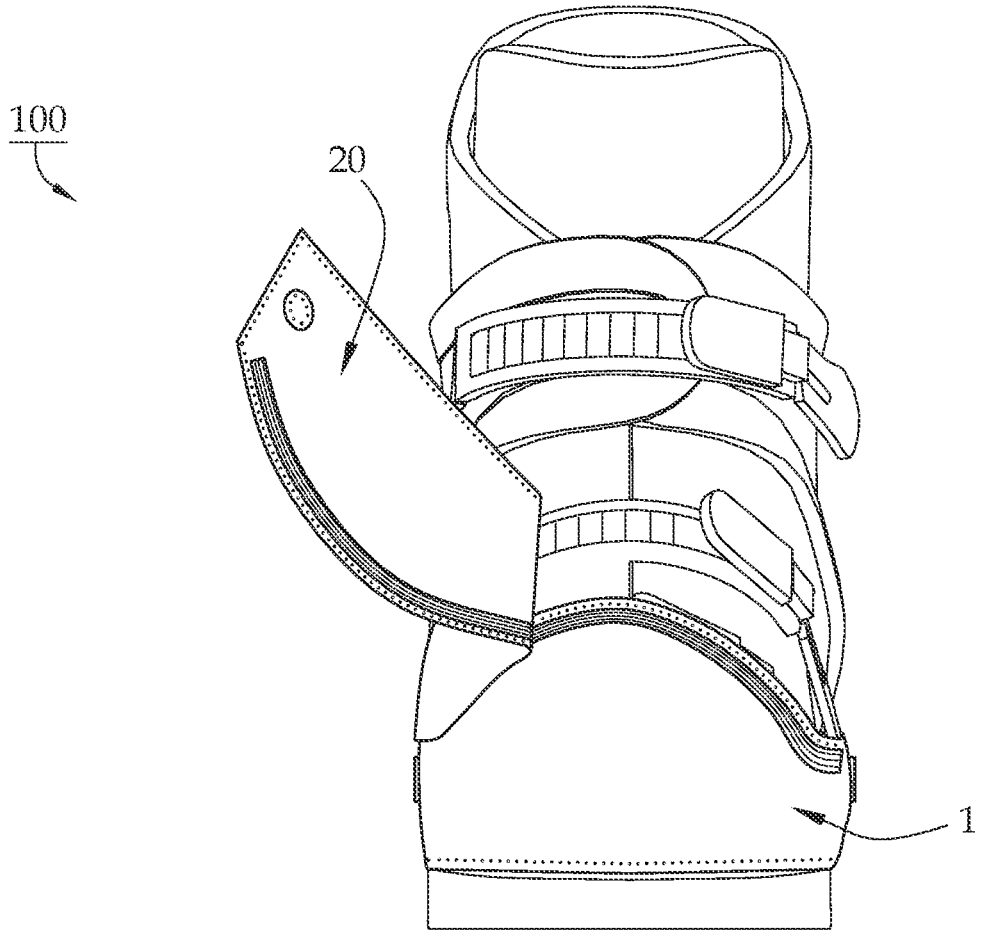
FIG. 9 illustrates front view of the boot and cover shown in FIG. 4, with the flap not fastened to the shell and only partially covering the second portion of the ski boot with two fastener strips of the flap and the shell.
Figure 10:
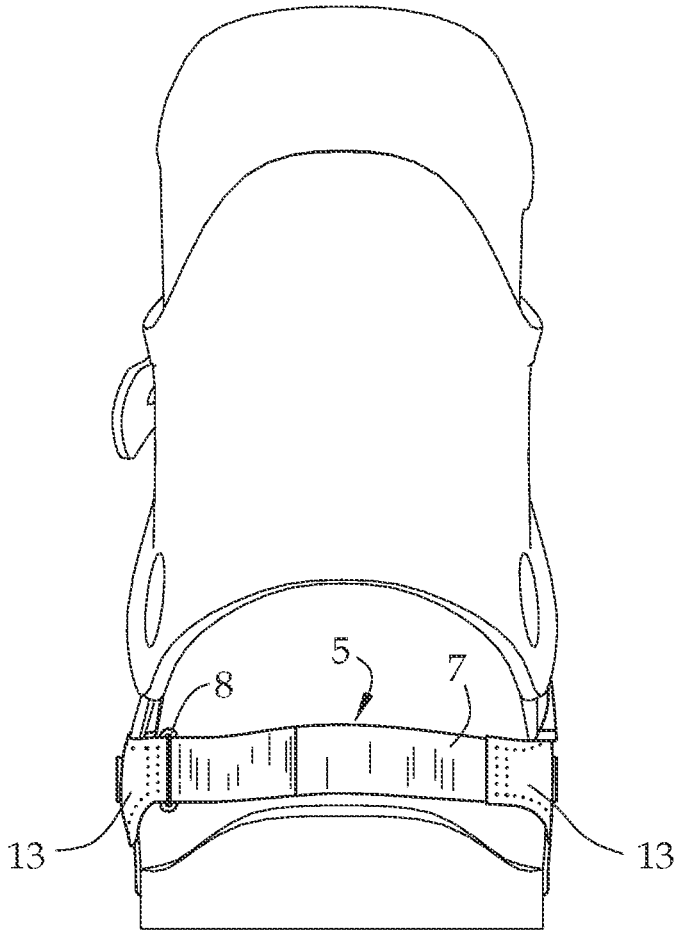
FIG. 10 illustrates a rear view of the boot and cover shown in FIG. 1.
Figure 11:
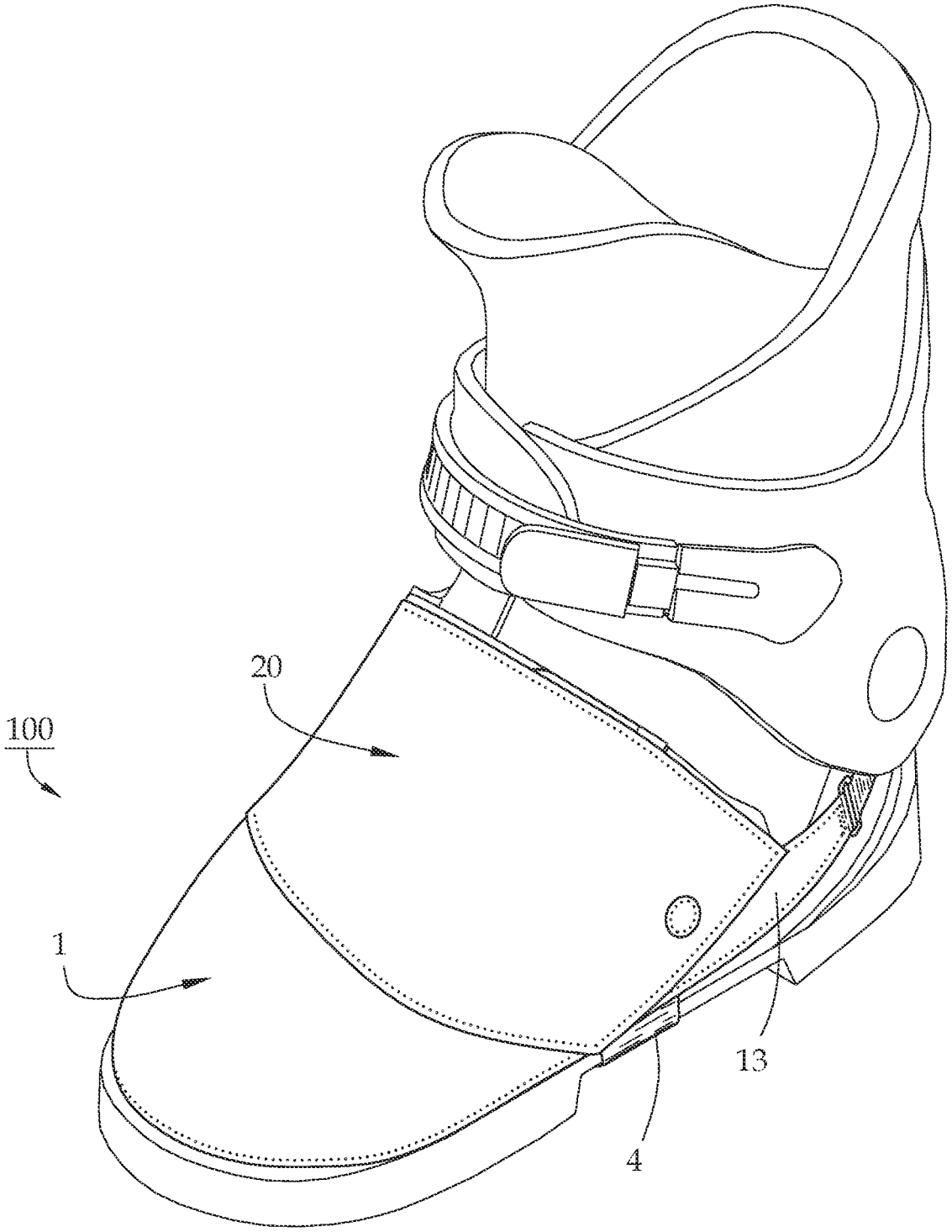
FIG. 11 illustrates a perspective view of the boot and cover shown in FIG. 1.

Referring first to FIG. 8, the preferred boot cover 100 as described below is configured to be deformable over a ski boot 30. The ski boot 30 and any of its components, features, and limitations shall not be construed as a limitation or requirement of any embodiment of boot cover 100 unless expressly stated. One embodiment of ski boot 30 as seen in FIG. 8 is comprised of a first portion 31 and a second portion 32. Said first portion 31 is positioned proximate to a toe portion 35 of the ski boot 30. Said second portion 32 is positioned less proximate to the toe portion 35 and is in series with the first portion 31. The second portion 32 includes one or more foot buckles 34. Said one or more foot buckles 34, when buckled, prevents the ski boot 30 from becoming loose around a skier's foot during use. The ski boot 30 comprises a shin buckle 33. The shin buckle 33 is positioned proximate to the second portion 32 of the ski boot 30 and prevents the ski boot from being loose around a skier's shin during use. The ski boot 30 further comprises a heel portion 36, bottom portion 37, a top portion 38, and a cleft 39.

Figure 4:
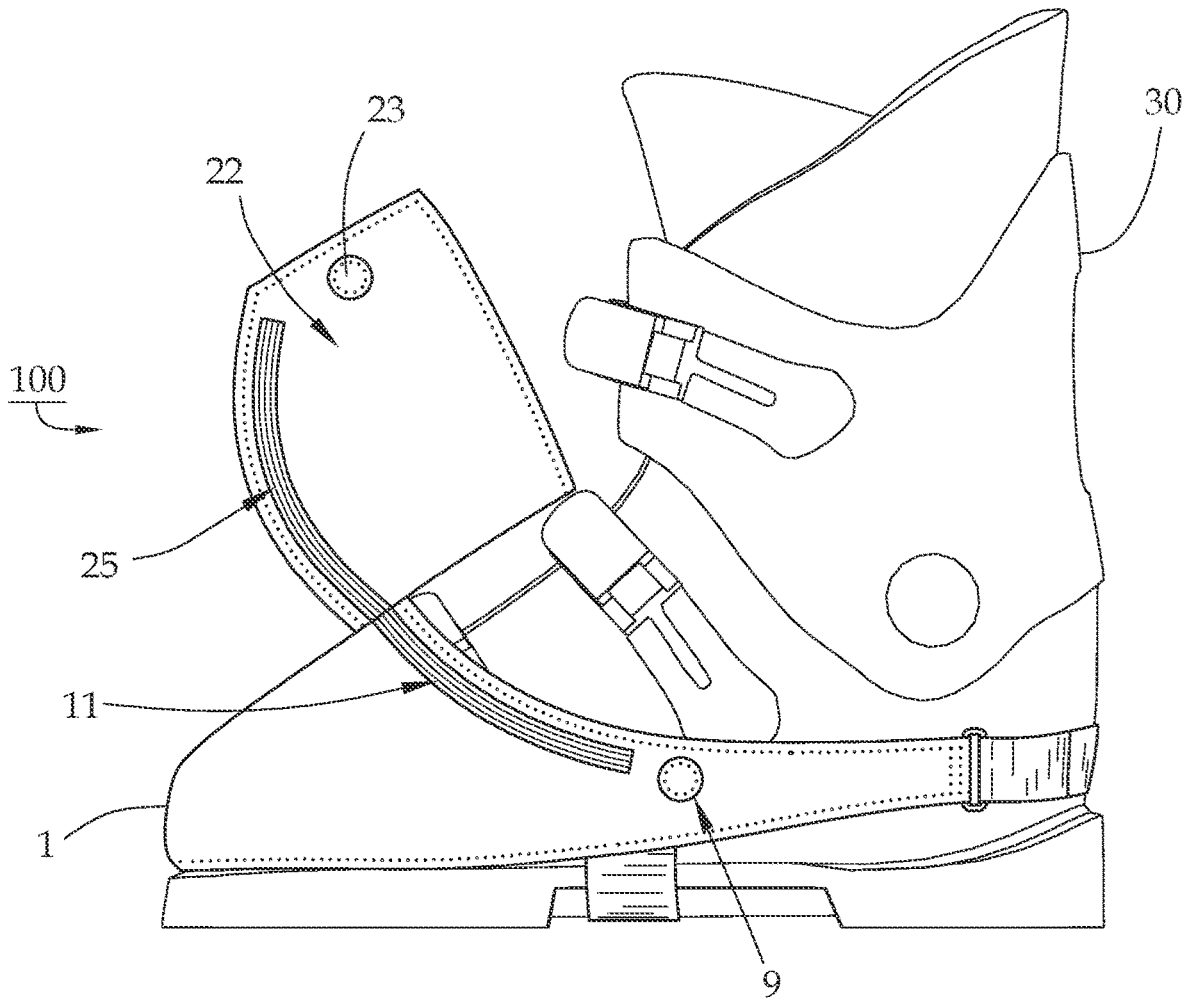
FIG. 4 demonstrates an elevated side view of the boot and cover of FIG. 2, with the flap not fastened to the shell and only partially covering the second portion of the ski boot with two fastener strips of the flap and the shell.
Figure 7:
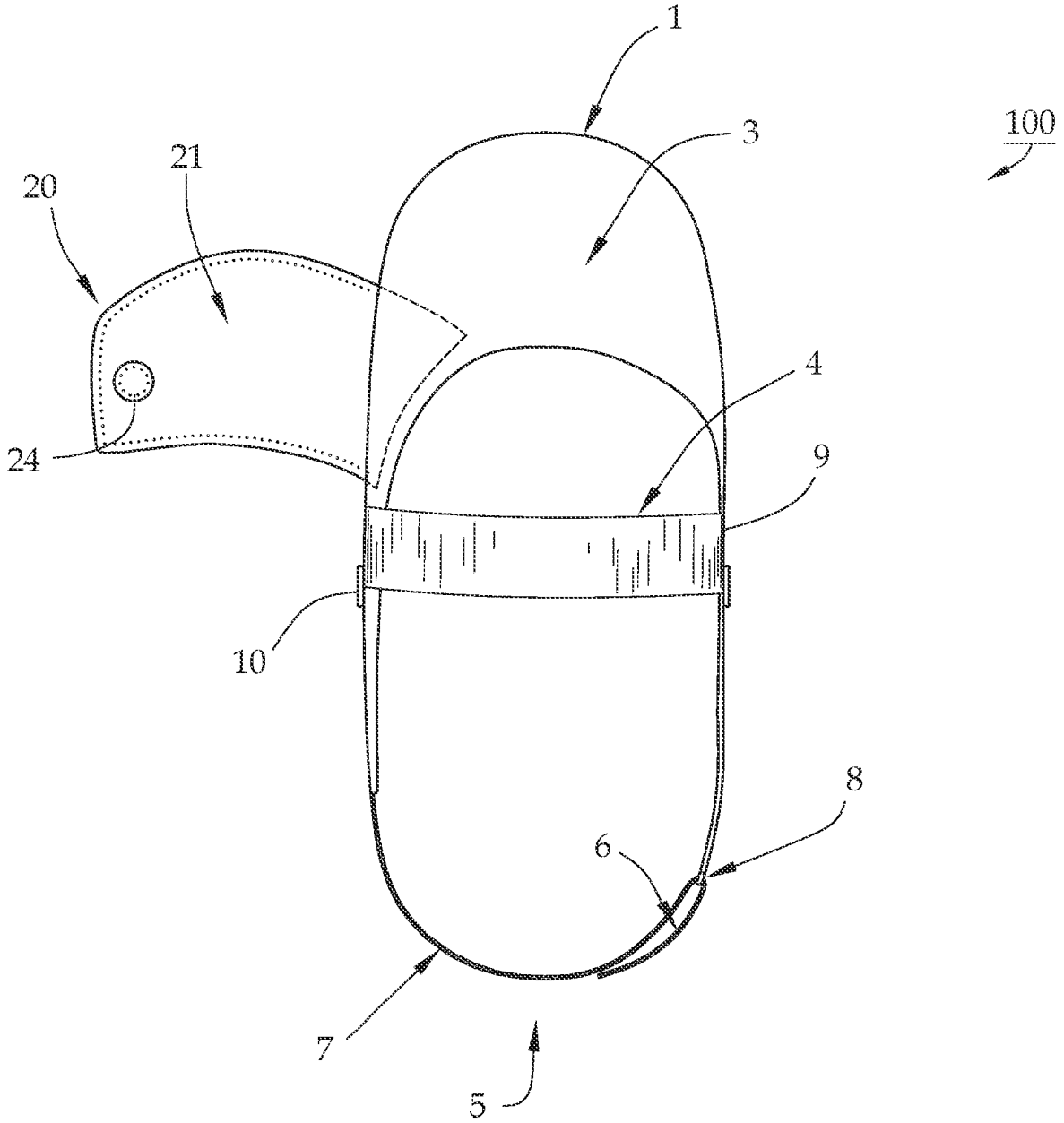
FIG. 7 shows a bottom plan view of the boot cover of FIG. 6 as removed from the boot, showing the flap, the outer flap surface, the shell, and the inner shell surface.

For a better understanding of the disclosure and its operation, turning now to the drawings at least in FIGS. 1 and 4, in one or more embodiments, the boot cover 100 comprises a shell 1 and a flap 20. In the preferred embodiment, the shell 1 and flap 20 are each configured to cover the first portion 31 and the second portion 32 of the ski boot 30, respectively. The shell 1 defines an outer shell surface 2 and an inner shell surface 3 (FIG. 7). The flap 20 defines an outer flap surface 21 and an inner flap surface 22. The inner flap surface 22 preferably engages the second portion 32 of the ski boot 30 and the inner shell surface 3 engages the first portion 31 of the ski boot 30 to increase the insulation of the ski boot 30 and prevent the internal temperature of the ski boot 30 from dropping. In a preferred embodiment, the shell 1 defines two extensions 13. Said extensions 13 are positioned opposite to one another on the shell 1 and are each positioned at a point on the shell 1 proximate to the heel portion 36 of the ski boot 30. Said extensions 13 each extend in the direction the heel portion 36 of the ski boot 30.

In reference to FIGS. 1-4, the flap 20 may be configured to cover the second portion 32 of the ski boot 30. Said flap 20 defines a perimeter 26. A portion 27 of the perimeter 26 is affixed to the shell 1 positioned proximate to a first lateral side 41 of the ski boot 30. The flap 20 is preferably configured to be releasably attachable to the shell 1 proximate a portion 28 of the perimeter 26 positioned proximate to a second lateral side 42 of the ski boot 30 different from the first lateral side 41 of the ski boot 30. When the flap 20 is releasably attached to the shell 1, a portion of said flap 20 overlays a portion of the shell 1.

Considering FIGS. 1, 2, 8, and 10, in one or more embodiments of the boot cover 100, the shell 1 preferably further comprises one or more straps, and, in the preferred embodiment, a first strap 4 and a second strap 5, and a hoop 8. The first strap 4 is configured to be connected at two points on the shell 1 in opposing relation with each other and configured to embrace with the bottom portion 37 of the ski boot 30. The engagement of the first strap 4 and the bottom portion 37 of the ski boot 30 prevents the shell 1 and the flap 20 from displacing from the first portion 31 and second portion 32 of the ski boot 30, respectively. In the preferred embodiment, the first strap 4 is formed from an elastic material. The second strap 5 and hoop 8 configured to be connected to the shell 1 at two different points that are in opposing relation with one another, preferably the second strap 5 is connected an end portion of one of the extensions 13 and the hoop 8 is connected to an end portion of the other extension 13. The preferred second strap 5 defines a first gripping surface 6 and a second gripping surface 7. The second strap 5 and hoop 8 are configured so that a portion of the first gripping surface 6 nearest to an end of the second strap 5 that is not attached to the shell 1 is insertable through the hoop 8 and then mated to a portion of the second gripping surface 7 as seen in FIG. 7 nearest to an end of the second strap 5 that is attached to the shell 1, the mating of these portions of the first gripping surface 6 and the second gripping surface 7 prevent the shell 1 and the flap 20 from displacing from the first portion 31 and second portion 32 of the ski boot 30, respectively, by embracing the heel portion 36 of the ski boot 30.

Figure 3:
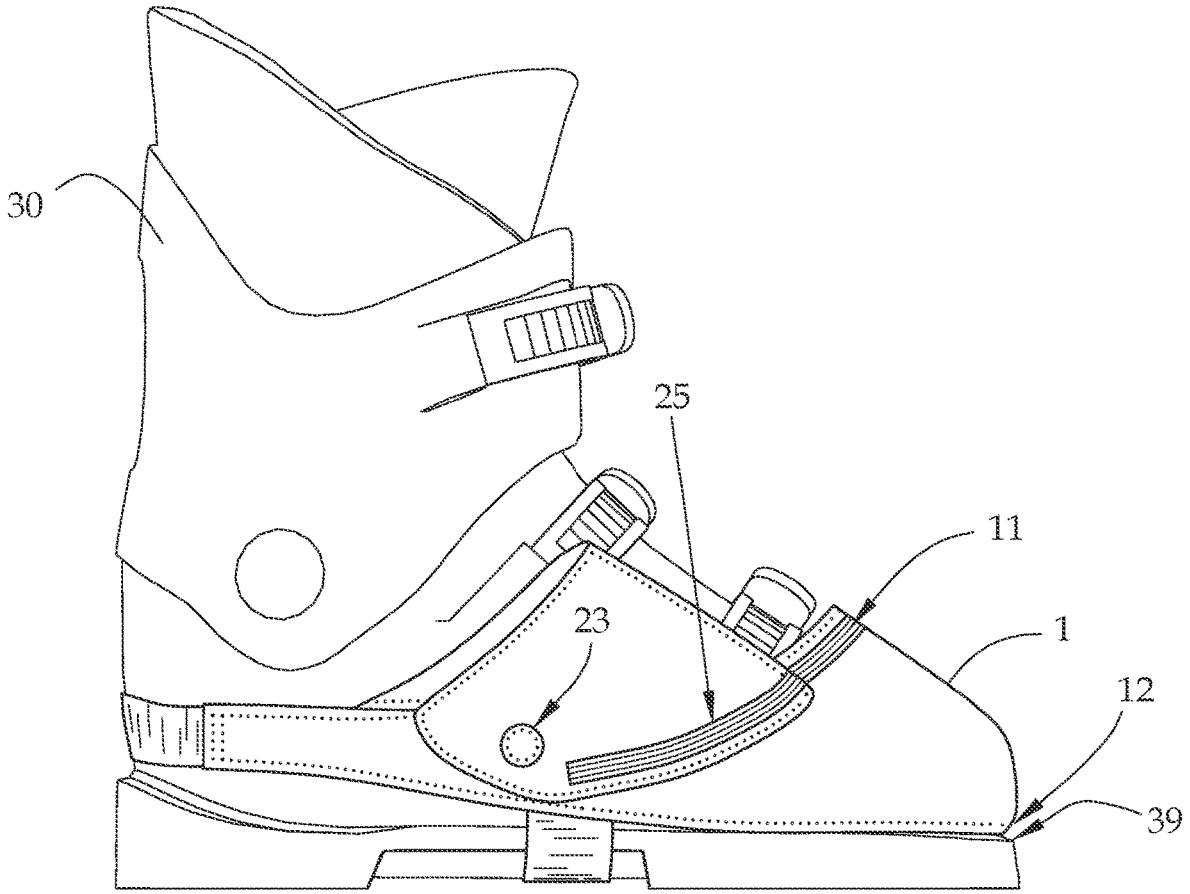
FIG. 3 depicts an elevated side view of the boot and cover of FIG. 1, with the flap fastened to the shell and the first portion of the ski boot covered by the shell and the second portion of the ski boot partially covered by the flap.
Figure 5:
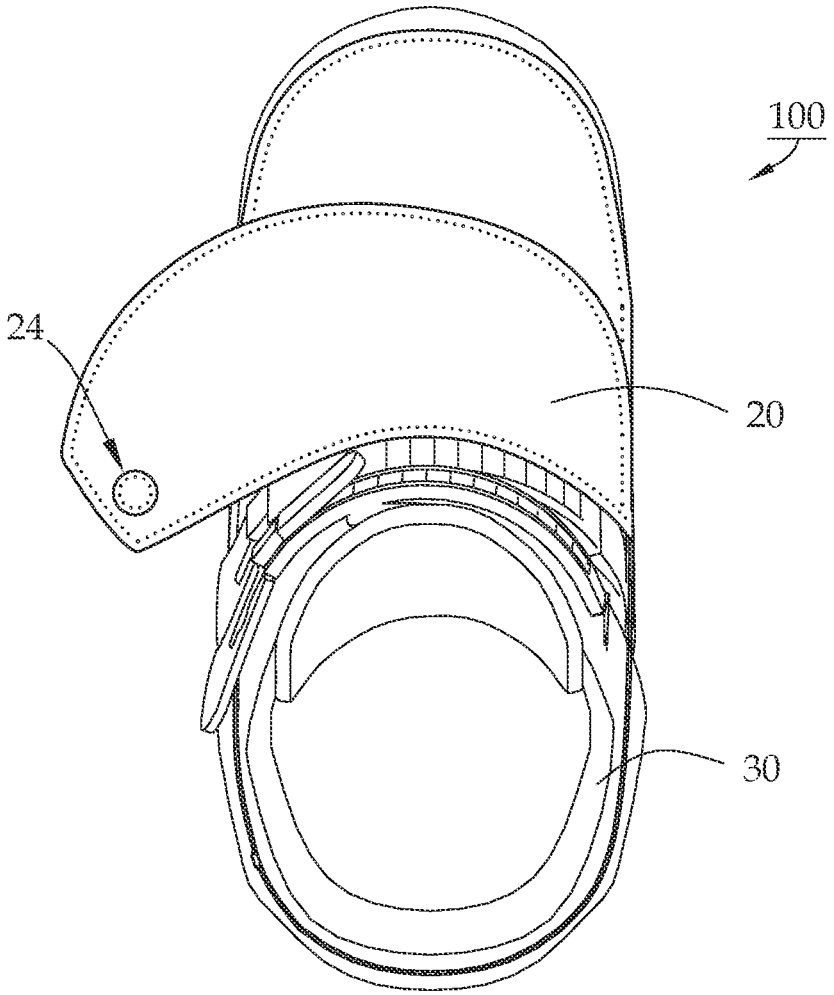
FIG. 5 illustrates a top plan view of the boot and cover of FIG. 1, with the flap covering the second portion of the ski boot but not fastened to the shell.
Figure 6:
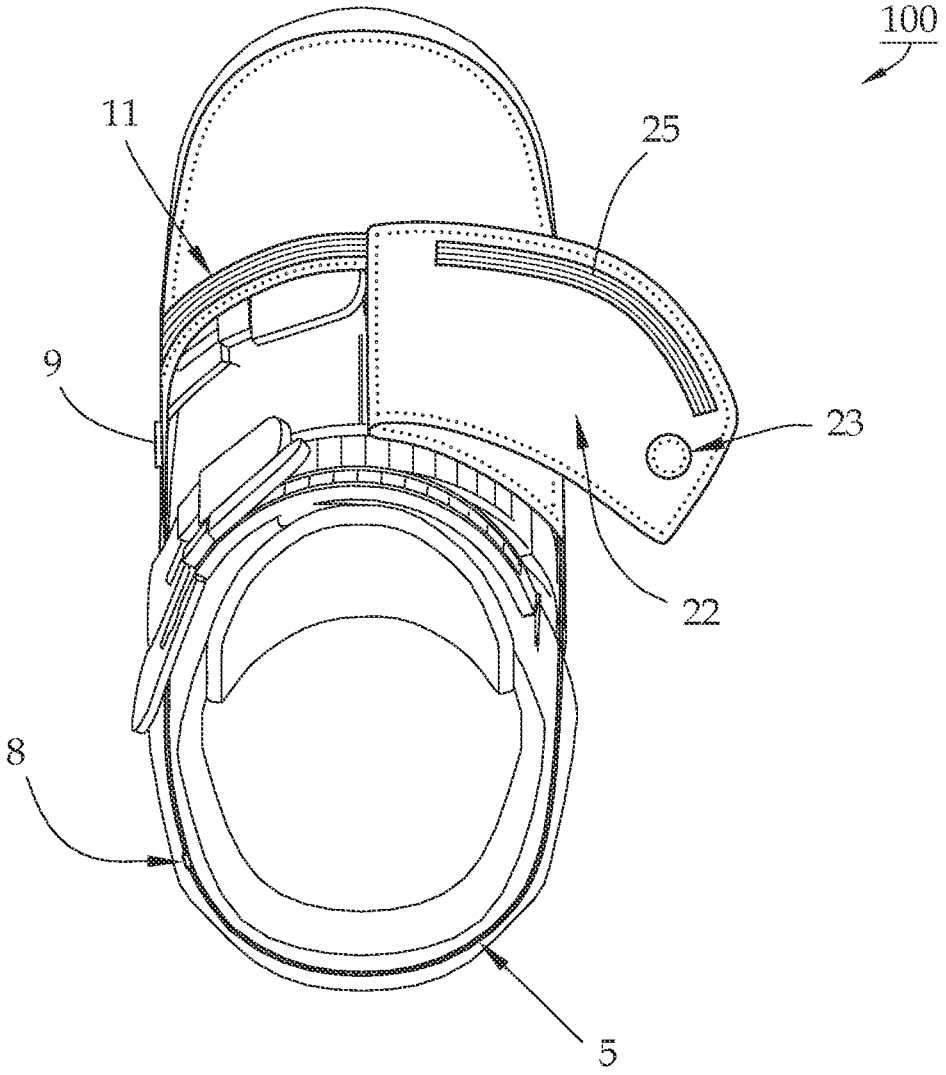
FIG. 6 features a top plan view of the boot and cover of FIG. 2, with the flap partially covering the second portion of the ski boot but not fastened to the shell.

Turning to FIGS. 1-6, 8, 9 and 11, in one or more embodiments of the boot cover 100, preferred shell 1 includes a first shell fastener component 9 (FIG. 4) and a second shell fastener component 10 (FIG. 2), and the flap 20 includes a first flap fastener component 23 (FIG. 6) and a second flap fastener component 24 (FIG. 5). The first shell fastener component 9 and first flap fastener component 23 cooperate to releasably attach the flap 20 to the shell 1. The flap 20 is configured to fully cover the second portion 32 of the ski boot 30 and is prevented from displacing from the second portion 32 of the ski boot 30 when the first shell fastener component 9 and the first flap fastener component 23 are cooperating. In the preferred embodiment, the flap 20 is configured to overlay a portion of the shell 1 when the first shell fastener component 9 and the first flap fastener component 23 are cooperating. The configuration of the flap 20 and the shell 1 when the first shell fastener component 9 and the first flap fastener component 23 are cooperating as seen in FIG. 1, is the configuration that is exhibited when the skier in wearing the boot cover 100 is actively engaged in skiing or does not otherwise need to access the second portion 32 of the ski boot 30. The second shell fastener component 10 and the second flap fastener component 24 cooperate to releasably attach the outer flap surface 21 of flap 20 to the shell 1. The flap 20 is configured to partially cover the second portion 32 of the ski boot 30 when the second shell fastener component 10 and the second flap fastener component 24 are cooperating. The configuration of the flap 20 and the shell 1 when the second shell fastener component 10 and the second flap fastener component 24 are cooperating as seen in FIG. 3, is the configuration that is exhibited when the skier is attempting to access the second portion 32 of the ski boot 30, for example when walking in ski boots to or from the ski hill. In one or more embodiments, the first shell fastener component 9, the first flap fastener component 23, the second shell fastener component 10, and second flap fastener component 24 are snap fasteners.

Referring to FIGS. 3, 4, 6, and 9 the preferred boot cover 100 further comprises a shell fastener strip 11 and a flap fastener strip 25. The shell fastener strip 11 may be located on the outer shell surface 2 and the flap fastener strip 25 is located on the inner flap surface 22. The shell fastener strip 11 and flap fastener strip 25 cooperate to releasably attach the flap 20 to the shell 1 and prevent the flap 20 from displacing from the second portion 32 of the ski boot 30. In the preferred embodiment, the second portion 32 of the ski boot 30 is fully covered when the shell fastener strip 11 and the flap fastener strip 25 are cooperating. The shell fastener strip 11 and flap fastener strip 25 can be fasteners such as, but not limited to, zippers, hook-and-loop fasteners, snap fasteners, and buttons.

Referring to FIGS. 1 and 3, in one or more embodiments, the shell 1 and flap 20 are configured to be deformable over the top portion 38 of the ski boot 30 to the cleft 39 of the ski boot 30 located proximate to the toe portion 35 of the ski boot 30. The shell 1 includes a cleft cover portion 12 that is deformable over the cleft 39.

The illustrations and examples provided herein are for explanatory purposes and are not intended to limit the scope of the appended claims.

The invention claimed is:

1. A boot cover comprising:

a shell with one or more straps, the shell configured to cover a first portion of a boot, the shell defining an outer shell surface and an inner shell surface, and a flap defining a perimeter having a first perimeter portion affixed to a second lateral side of the shell and a second perimeter portion releasably attachable to a first lateral side of the shell, the flap configured to cover a second portion of the boot, the second portion different from the first portion, the flap defining an outer flap surface and an inner flap surface, wherein the shell is configured to be deformable over a top portion of the boot to a cleft of the boot located proximate to a toe portion of the boot.

2. The boot cover of claim 1, wherein the first lateral side of the shell includes a first shell fastener component, and the inner flap surface of the flap includes a first flap fastener component; wherein the first shell fastener component and the first flap fastener component cooperate to releasably attach the flap to the shell.

3. The boot cover of claim 2, wherein the flap is configured to fully cover the second portion of the boot when the first shell fastener component and the first flap fastener component are cooperating.

4. The boot cover of claim 2, wherein releasably attaching the flap to the shell via cooperation of the first shell fastener component and the first flap fastener component prevents the flap from displacing from the second portion of the boot.

5. The boot cover of claim 2, wherein the shell includes a second shell fastener component on the second lateral side of the shell, and the flap includes a second flap fastener component on the outer flap surface; wherein the second shell fastener component and the second flap fastener component cooperate to releasably attach the flap to the shell.

6. The boot cover of claim 5, wherein the flap is configured to partially cover the second portion of the boot when the second shell fastener component and the second flap fastener component are cooperating.

7. The boot cover of claim 6, wherein the first and second shell fastener components and the first and second flap fastener components are snap fasteners.

8. The boot cover of claim 1, further comprising:

a shell fastener strip, the shell fastener strip is positioned on the outer shell surface;

a flap fastener strip, the flap fastener strip is positioned on the inner flap surface;

wherein, the shell fastener strip and the flap fastener strip cooperate to releasably attach the flap to the shell.

9. The boot cover of claim 8, wherein the shell fastener strip and the flap fastener strip are hook-and-loop fasteners.

10. The boot cover of claim 1, further comprising a first strap; wherein the first strap is configured to be connected to the shell at two positions in opposing relation with one and other; and wherein the first strap is configured to embrace a bottom portion of the boot.

11. The boot cover of claim 10, further comprising:

a second strap; the second strap defining a first gripping surface and a second gripping surface; the first gripping surface and the second gripping surface each formed from a material that facilitates the releasable attachment of the first gripping surface to the second gripping surface when mated with each other;

a hoop;

wherein the second strap and the hoop are configured to be connected to the shell at positions that are in opposing relation with one and other; and wherein inserting the second strap through the hoop and attaching a portion of the first gripping surface nearest to an end of the second strap that is not attached to the shell to a portion of the second gripping surface nearest to an end of the second strap that is attached to the shell thereby preventing the shell from displacing from the first portion of the boot.

12. The boot cover of claim 1, wherein the flap is configured to overlay a portion of the shell.

13. A boot cover comprising:

a shell including a first shell fastener component on a first lateral side of the shell, the shell is configured to cover a first portion of a boot; and a flap including a first flap fastener component on an inner surface of the flap, the flap is configured to cover a second portion of the boot, the flap defines a perimeter, a portion of the perimeter is affixed to a second lateral side of the shell wherein the first flap fastener component is configured to be releasably attachable to the first shell fastener component;

wherein a portion of the flap overlays a portion of the shell; and wherein the shell is configured to be deformable over a top portion of the boot to a cleft of the boot located proximate to a toe portion of the boot.

14. The boot cover of claim 13, wherein the flap is configured to fully cover the second portion of the boot when the first shell fastener component and the first flap fastener component are cooperating.

15. The boot cover of claim 13, wherein the shell includes a second shell fastener component on the second lateral side of the shell, and the flap includes a second flap fastener component on an outer surface of the flap; wherein the second shell fastener component and the second flap fastener component cooperate to releasably attach the flap to the shell.

16. The boot cover of claim 15, wherein the flap is configured to partially cover the second portion of the boot when the second shell fastener component and the second flap fastener component are cooperating.

17. The boot cover of claim 15, wherein the second shell fastener component and the second flap fastener component are fasteners selected from the group consisting of zippers, hook-and-loop fasteners, snap fasteners, and buttons.

18. The boot cover of claim 13, further comprising a first strap; wherein the first strap is configured to be connected to the shell at two positions in opposing relation with one and other; and wherein the first strap is configured to embrace a bottom portion of the boot.

19. The boot cover of claim 13, wherein the first shell fastener component and the first flap fastener component are fasteners selected from the group consisting of zippers, hook-and-loop fasteners, snap fasteners, and buttons.

20. The boot cover of claim 13, further comprising:

a shell fastener strip, the shell fastener strip is positioned on the outer shell surface;

a flap fastener strip, the flap fastener strip is positioned on the inner flap surface;

wherein, the shell fastener strip and the flap fastener strip cooperate to releasably attach the flap.

* * * * *